United States Patent [19]

Davis et al.

[11] 3,959,713

[45] May 25, 1976

[54] SOLID STATE CURRENT LIMIT CIRCUIT

[75] Inventors: Walter Richard Davis; Tim Warren Henry, both of Tempe, Ariz.

[73] Assignee: Motorola, Inc., Chicago, Ill.

[22] Filed: Mar. 27, 1975

[21] Appl. No.: 562,693

[52] U.S. Cl. ..... 323/9; 323/68; 317/23; 317/33 VR; 317/40 R

[51] Int. Cl.[2] ..... G05F 1/58

[58] Field of Search ..... 317/23, 33 VR, 33 R, 317/16, 40 R; 323/1, 4, 9, 68

[56] References Cited

UNITED STATES PATENTS

| | | | |
|---|---|---|---|
| 3,599,079 | 8/1971 | Ansbro et al. | 323/68 X |
| 3,691,426 | 9/1972 | Mankovitz | 317/23 |
| 3,697,860 | 10/1972 | Baker | 323/9 |
| 3,723,774 | 3/1973 | Rogers | 323/9 X |
| 3,753,078 | 8/1973 | Hiedel | 323/9 |

OTHER PUBLICATIONS

Electronics, Dec. 6, 1973; Vol. 46, No. 25; "Temperature Limiting Boosts Regulator Output Current" by M. J. Shah, pp. 112, 113.

*Primary Examiner*—Gerald Goldberg
*Attorney, Agent, or Firm*—Michael D. Bingham; Maurice J. Jones, Jr.; Harry M. Weiss

[57] ABSTRACT

A current limit circuit is disclosed for sensing the current drain of a load connected in series therewith. Under normal operating conditions the circuit presents a relatively low impedance in series with the load. Circuit overload protection is provided if the current increases above a predetermined value by a current limiting circuit provided for limiting the current conducted therethrough. In response to the current limiting condition, thermal shutdown of the circuit occurs to reduce the current that is supplied to the load to a predetermined minimum value i.e., the current limit circuit presents an impedance to the load which is relatively much greater than the impedance of the current limit circuit during normal operating conditions. After a predetermined time, the current limit circuit is again rendered operative and if the circuit overload condition is still present the aforedescribed cycle is repeated until the fault condition is corrected.

12 Claims, 4 Drawing Figures

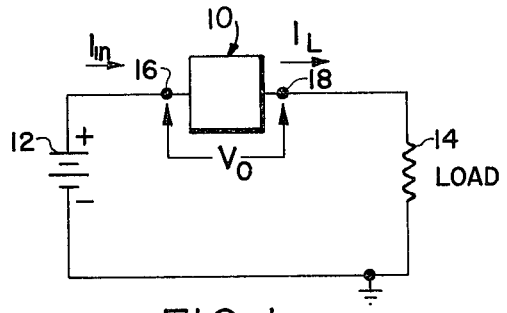
FIG. 1
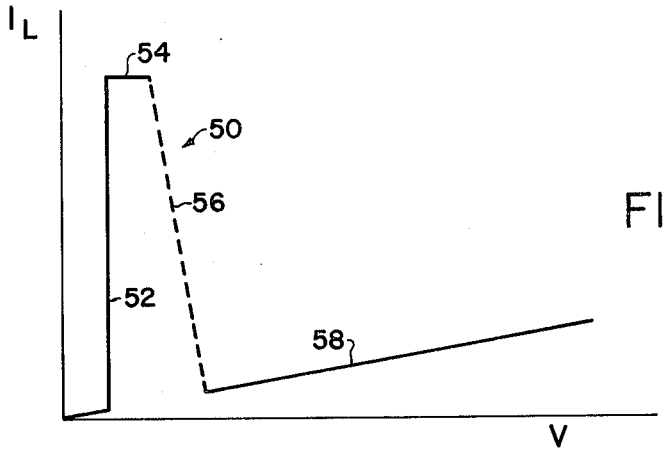
FIG. 3
FIG. 2
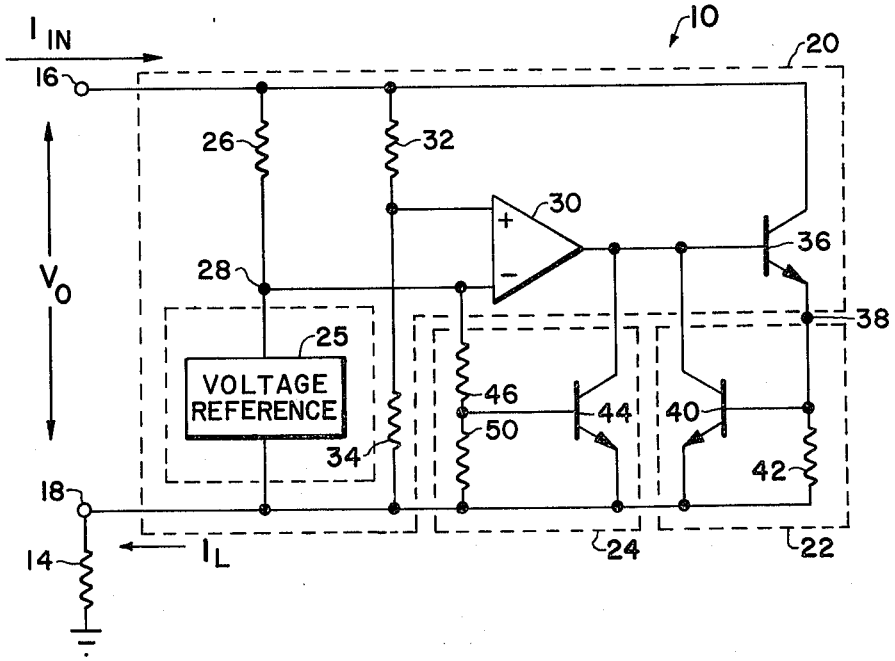

$I_{IN}$
10
16
18
14
38
22
24
25
30
P

SOLID STATE CURRENT LIMIT CIRCUIT

BACKGROUND OF THE INVENTION

The present invention is related to electronic solid-state fuses and more particularly to an electronic current limit circuit for limiting the current drain of a series connected load, and for switching the magnitude of the impedance of the current limit circuit from a low-impedance state to a high-impedance state to prevent excessive power dissipation by the circuit.

Basic current limiting devices such as fuses and resistive elements, for example, lamps, are well known in the art. However, fuses have the disadvantage in that they must be replaced each time that a current overload condition causes them to "open" circuit. Lamps suffer from the disadvantage of having high impedances and low speed response time with respect to momentary high energy, short duty cycle, pulses which may arise in solid-state circuits.

Other prior art circuits constituted by voltage regulators and thermal overload protection are also known. However these circuits normally "sense" an output voltage and have a feedback path which controls the supply voltage applied to the circuit. The disadvantage of the above circuits is that they provide voltage regulating techniques which require an additional current to provide the basic protection function which, is not necessarily the current that is seen by the load. Hence, more power is required by such circuits over that of the present invention.

Other solid state switching applications have utilized voltage-controlled devices of the breakdown or regenerative type. These devices are normally open voltage-controlled devices which are in a high-impedance state and then switched to a low-impedance state upon reaching a trigger or breakdown voltage brought about by positive feedback. However, the above devices do not sense the current seen by the circuit load and suffer from the same disadvantage of the previously described voltage regulators.

Therefore, a need exists to develop a solid state current limiting device for sensing the current through a series connected load element and to limit the current through the load when a predetermined magnitude of current is conducted therethrough because of circuit overload conditions.

SUMMARY OF THE INVENTION

It is an object of this invention to provide an improved current limit circuit.

Another object of this invention is to provide a solid state current limit circuit for limiting the magnitude of the current which may be conducted through a series connected load element due to circuit overload conditions.

A further object is to provide a current limit circuit configuration for switching the circuit from a low-impedance state to a high-impedance state in response to an overload current condition.

A still further object is to provide a current limit circuit configuration having a thermal shutdown circuit to limit the current conducted through a load element in response to an overload circuit condition.

An additional object is to provide a current limit circuit suitable to be manufactured in monolithic integrated circuit form for sensing the current conducted through a load element thereby switching from a low impedance state to a high impedance state in response to an overlaod current condition.

The current limit circuit configuration and method of current limiting of the invention are suitable for providing a high speed current limiter having an extremely low impedance, under normal operating conditions, and being connected in series with a load element. If the load current increases above a predetermined value, due to a current overload condition, a current limiting circuit is rendered operative to thereby limit the current conducted therethrough. moreover, the current limit circuit provides thermal shutdown as the temperature of the circuit increases above a predetermined value in response to the overload condition, thereby reducing the current to the load to a minimum value in order to protect the load. The current limit circuit includes, an current supplying circuit, a current limiting circuit, and a thermal responsive circuit. The current limit circuit is adapted to be placed in series with the load element and to be connected to a power supply. The current supplying circuit includes; an error amplifier circuit, a first voltage reference circuit, a second voltage reference circuit, and an output circuit. The first voltage reference circuit is adapted to be connected across the input and output terminals of the current limit circuit and provides a constant voltage magnitude to one input terminal of the error amplifier circuit at an output terminal thereof. The second voltage reference circuit having an output terminal connected to a second input terminal of the error amplifier circuit and being connected across the input and output terminals of the current limit circuit, senses the voltage across the respective terminal thereof. The error amplifier circuit includes a negative feedback path for maintaining the voltage level applied thereacross by the first voltage reference circuit and the second voltage reference circuit constant. The current limiting circuit is adapted to sense the current supplied to the load element from the error amplifier circuit and limits the magnitude of the current conducted therethrough to a predetermined value. If a current overload condition should arise, due, for example, short circuit conditions of the load, the current is thus limited to a predetermined magnitude. However, the temperature of the error amplifier circuit will increase until such time that the thermal responisve circuit becomes operative. Because the thermal responsive circuit is adapted to be connected across the input of an output device of the error amplifier, as the thermal responsive circuit becomes operative current is shunted away from this device which reduces the current supplied to the load to a minimum value. In response to the activation of the thermal responsive circuit the temperature of the error amplifier decreases until the thermal responsive circuit is rendered nonoperative. If the current overload condition is still present, the aforedescribed circuit operation is repeated.

Several advantages are obtained by the current limit circuit; high speed response to current overload conditions for limiting the current conducted through a load, thermal shutdown for preventing high currents from being conducted through the load for long periods of time, and automatic restart of the current limit circuit as normal operating conditions are restored.

BRIEF DESCRIPTION OF THE DRAWINGS

FIG. 1 is a simplified, partial schematic and block diagram illustrating the embodiment of the invention;

FIG. 2 is a partial schematic and block diagram illustrating the embodiment of the invention in a simplified manner;

FIG. 3 is a waveform diagram of the operating characteristics of the invention which is useful for understanding the function thereof.

DETAILED DESCRIPTION OF THE INVENTION

Figure 4:
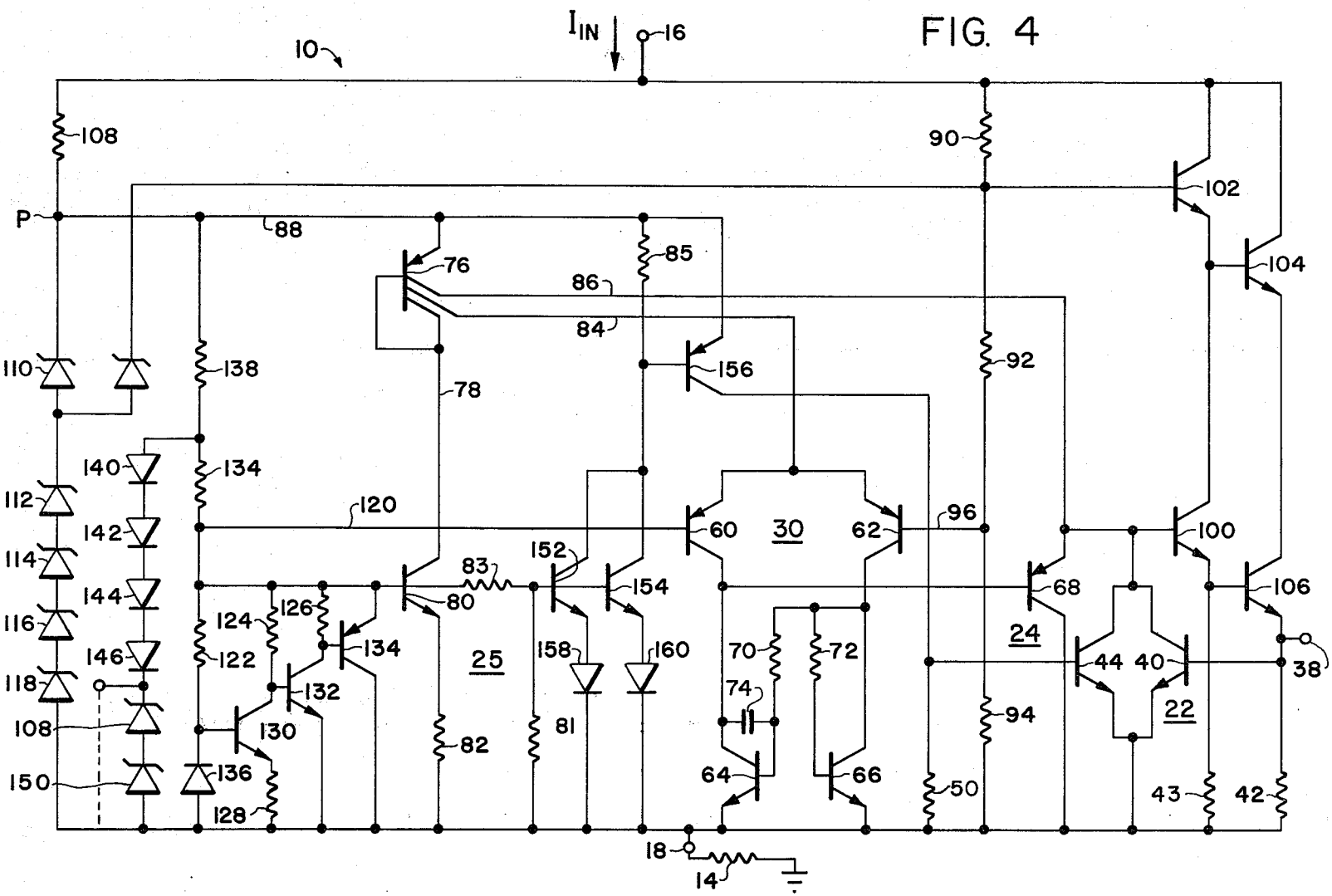
FIG. 4 is a detailed schematic diagram of the embodiment of the invention.

The current limit circuit of the embodiment of the invention will be described with the aid of the illustrations provided herewith. Referring to FIG. 1, there is illustrated a current limit circuit 10 connected in series between power supply 12 and load 14. Current limit circuit 10 is a two-terminal device having input terminal 16 adapted to be connected to the positive terminal of power supply 12 and output terminal 18 connected to load 14. Under normal current drain conditions, when the magnitude of $I_L$ supplied to load 14 is less than a predetermined value, current limit circuit 10 has a very low impedance. If $I_L$ becomes excessive, current limit circuit 10 limits the magnitude of $I_L$ to a predetermined value. Moreover, if excessive power is dissipated by current limit circuit 10 (as will be later explained in greater detail) thermal shutdown will occur, switching the impedance of the current limit circuit 10 to an high-impedance state, thereby reducing the current supplied to load 14.

Current limit circuit 10 may be used to replace two basic current limiting devices; fuses and resistive elements, such as lamps.

FIG. 2 illustrates current limit circuit 10 of the embodiment of the invention. Current limit circuit 10 is shown as comprising: error amplifier 20, current limiting circuit 22, and thermal responsive circuit 24. Error amplifier 20 provides current to load element 14. Accordingly, the input thereof, senses the voltage across terminals 16 and 18 in order to vary the current in response thereto. Error amplifier 20 includes voltage reference circuit 25 connected in series with resistor 26 between terminals 16 and 18. The output of voltage reference circuit 25 is connected at the junction point 28 (between resistor 26 and voltage reference circuit 25) to the negative terminal of operational amplifier 30. The plus input terminal of operational amplifier 30 is connected to the junction point between series connected resistors 32 and 34 which form a resistive divider circuit connected between terminal 16 and 18 of current limit circuit 10. The output of operational amplifier 30 is connected to the base electrode of transistor 36 whose collector electrode is returned to input terminal 16. The emitter electrode of transistor 36 is adapted to be connected to output terminal 38 of error amplifier circuit 20. Current limiting circuit 22 includes transistor 40 and resistor 42. The base electrode of transistor 40 is connected to output terminal 38 of error amplifier 20 and to one end of resistor 42. The collector electrode of transistor 40 is connected to the base electrode of transistor 36, with the emitter electrode thereof connected to the other end of resistor 42 and to output terminal 18 of current limit circuit 10. Thermal responsive circuit 24 which is rendered operative under conditions of excessive power dissipation by current limit circuit 10 includes transistor 44 whose collector electrode is connected to the output of operational amplifier 30 and having its emitter connected to output terminal 18. The base electrode of transistor 44 is connected to the junction point between series connected resistors 46 and 50 which are connected between the minus input terminal of operational amplifier 30 and output terminal 18. Load 14 is adapted to be connected between output terminal 18 of current limit circuit 10 and a circuit reference ground terminal.

The operation of the embodiment illustrated in FIG. 2 will now be explained with the aid of the voltage-current waveform diagram of FIG. 3. In response to the power supply voltage being applied across current limit circuit 10 and load 14, voltage reference circuit 25 provides a predetermined and constant value of voltage to the negative terminal of operational amplifier 30. The positive terminal of operational amplifier 30 is referenced to a magnitude of voltage which is generated across resistor 34 of the resistive divider circuit. The voltage generated thereacross is therefore proportional to $V_O$, the voltage across terminals 16 and 18. Negative feedback is provided by transistor 36 which is connected to the output of operational amplifier 30 such that if the voltage magnitude across resistor 34 increases, the voltage dropped across transistor 36 and resistor 42 decreases to thereby keep $V_O$ substantially constant.

In normal operation, output current $I_L$ is conducted through transistor 36, resistor 42 and load 14. Current limit circuit 10, with $V_O$ being held constant, is in a low impedance state as is illustrated by portion 52 of waveform 50 (FIG. 3). If $I_L$ should reach a predetermined value, for example, 100 milliamps, which might be caused by a short circuit load condition, transistor 40 begins to conduct. In response to transistor 40 being rendered conductive, base current drive to transistor 36 is shunted through transistor 40 which, therefore, limits the current supplied by transistor 36 to load 14 (portion 54 of waveform 50), preventing additional current to be conducted thereto.

Because current limit circuit 10 is of monolithic integrated circuit form, the temperature of the integrated circuit chip will increase due to the excessive power dissipating condition described above. Therefore, as the temperature reaches a predetermined value, for example 140°±C., thermal responsive circuit 24 including transistor 44 is rendered operative. As the temperature increases, the voltage required to render transistor 44 conductive decreases. Thus, the voltage applied to the base of transistor (across resistor 50) being substantially constant, is sufficient to render transistor 44 conductive at the aforementioned temperature. Current limit circuit 10 then goes through a negative-resistance transition, portion 56 of waveform 50, during thermal shutdown of the circuit. With transistor 44 being completely turned on, the only current flowing through current limit circuit 10 is through the resistive voltage divider circuit comprising resistors 46 and 50, and current limit circuit 10 is then in a high impedance state, illustrated by that part of waveform 50 of FIG. 3 designated by reference numeral 58. The temperature of the monolithic chip will decrease in conjunction with thermal responsive circuit 24 being activated until a value is reached at which transistor 44 is shut off, allowing normal circuit operation (low-impedance state) once again of current limit circuit 10. However, if the short condition of the load is still present, the circuit will again heat up and turn off. This cycle will be repeated until the faulty shorted load condition is corrected.

One significant improvement provided by the embodiment of FIG. 2 over the prior art is the inclusion of thermal shutdown of current limit circuit 10. Thermal responsive circuit 24 provides protection to the devices of the current limit circuit 10 during excessive power dissipating conditions for protecting the devices thereof. In known prior art circuits of the current limiting type, overheating due to shorted load conditions, for example, might well destroy the devices of these circuits.

As an aside, current limit circuit 10 also provides a much lower impedance during normal circuit operation than some prior art circuits. This can be seen from waveform 50, i.e., the slope of portion 52 is very sharp. For example, in normal operation, the nominal impedance level of current limit circuit 10 is 0.24 ohms with $V_O$ being typically 4 volts.

In FIG. 4, the same reference numbers are used for components corresponding to like components of FIG. 2. The structure of the circuit of FIG. 4, which is suitable to be manufactured in monolithic integrated circuit form, operates in the same manner as previously discussed for the configuration of FIG. 2. Modifications to the circuit of FIG. 2 have been made, which provide improved performance of that circuit.

Operational amplifier 30 is shown as being comprised of a single ended differential amplifier consisting of transistor pairs 60 and 62 and including transistors 64, 66 and 68, resistors 70 and 72, capacitor 74. The single ended output of the differential amplifier is applied to the base of transistor 68 with the output of operational amplifier 30 being taken at the emitter electrode thereof. A constant current source which includes transistor 76 is provided to the emitters of transistors 60 and 62 via lead 84 which is connected to one of the collector electrodes of transistor 76. Transistor 76 also provides the current source to transistor 68 via lead 86 which is connected between a second collector of transistor 76 and the emitter electrode of transistor 68. The third collector electrode of transistor 76 is returned to its base electrode and is connected in series with transistor 80 and resistor 82 over lead 78. Bias voltage to the emitter of transistor 76 (via lead 88) is provided at junction point P. During normal operation (waveform 52, FIG. 3) a constant bias voltage is generated at point P, as is understood, through the voltage divider circuit comprising resistors 108, 138, 134 and voltage reference circuit 25. When thermal shutdown occurs (waveform 58) the voltage across terminals 16 and 18 is sufficient to render zener diodes 110–118 conductive. Thus, during circuit overload conditions, the voltage magnitude at point P is limited to a predetermined value, for example, 35 volts by the zener diodes for protection of voltage reference circuit 25 and operation amplifier 30.

The resistive divider circuit which includes series connected resistor 90, 92, and 94 connected between terminal 16 and 18 corresponds to the aforementioned resistive divider network of FIG. 2 and provides a voltage control signal to the base of transistor 62 (the plus input terminal of operational amplifier 30) via lead 96 which is connected between the junction point between resistors 92 and 94. Error amplifier 20 has been modified to include cascoded output devices 100, 102, 104, and 106 and resistor 43 (replacing transistor 36 of FIG. 2) in order to standoff higher voltage magnitudes generated across terminals 16 and 18 during thermal shutdown of current limit circuit 10. An additional output is taken from the aforementioned voltage divider circuit at the junction between resistors 90 and 92 to bias transistor 102. The output of operational amplifier 30 is connected between the electrode of transistor 68 and the base electrode of transistor 100 with the output of error amplifier 20 being adapted to supply current to load 14 at terminal 38. Voltage reference 25 connected to the base of transistor 60 (the minus terminal of operational amplifier 30) via lead 120 comprises resistor 122, 124, 126, and 128, transistors 130, 132, and 134, and diode 136. Voltage reference 25 provides a fixed voltage reference to operational amplifier 30 as previously discussed. Voltage reference 25 may be a conventional $\Delta V_{BE}$ voltage reference circuit known in the art. Bias to voltage reference circuit 25 is provided over lead 88 through the series connection of resistors 138 and 134 which are connected to resistor 122 of voltage reference circuit 25. The series combination of diodes 140–150 which are connected between terminal 18 and the junction point between resistors 138 and 134 provides for limiting the voltage level applied to resistor 134 and, thus, the current supplied to voltage reference circuit 25 during thermal shutdown. Zener diodes 108 and 150 may be excluded from the aforedescribed combination of diodes by utilizing a shorting strap, for example, between the cathode of diode 146 and terminal 18.

The operation of error amplifier 20 of the circuit of FIG. 4 operates in the same manner as previously discussed for the corresponding error amplifier of FIG. 2. Again, if the voltage across the resistive divider network including resistors 90, 92 and 94 should begin to increase, negative feedback is provided by cascoded transistors 100, 102, 104, and 106 such that current is pulled from the output of operational amplifier 30, to reduce the voltage across the cascoded output transistors to reduce the voltage applied thereacross, which in turn, reduces the voltage across the resistor divider network thereby maintaining a constant voltage across terminal 16 and 18 of current limit circuit 10.

Current limiting circuit 22 is identical to the corresponding circuit as described for FIG. 2. However, thermal responsive circuit 24 is shown as including extra transistors 152, 154 diodes 158 and 160 which are coupled to lead 88 through resistor 85, and transistor 156 which is connected to the base of transistor 44. The base electrode of trasistor 156 is connected to the opposite end of resistor 85 and is also coupled to lead 88, which supplies base driving current thereto. Base bias is supplied to transistors 152 and 154 through resistor 83 which is coupled through resistor 81 to output terminal 18 of current limit circuit 10. The base of transistor 44 is returned to output terminal 18 through resistor 50. The extra transistors are used in thermal responsive circuit 24 so as to $\beta$ multiply the current generated as the circuit is rendered operative for generating a sharper shutdown characteristic (a steeper slope of waveform portion 50 of FIG. 3).

The circuits of FIG. 2 and FIG. 4 both utilize the same method of current limiting and thermal shutdown. More specifically, the two terminal current limit circuit is connected in series between one terminal of a power supply and an external load which is returned to the other terminal of the power supply. A voltage reference source is connected to one input terminal of operational amplifier 30 with its second input terminal connected to a second voltage reference network which is connected across the input and output terminal of the current limit circuit. Acordingly, negative feedback is provided between the output of the operational amplifier to its input in order to maintain both of the inputs thereof at the same voltage level so as to maintain a constant voltage across the input and output terminals of the current limit circuit. In response to a current overload condition, a current limiting circuit limits the magnitude of current which is conducted through the load. Furthermore, a thermal responsive circuit is rendered operative in response the temperature rise of the current limit circuit due to excessive power dissipation so as to thermally shutdown the current limit circuit to maintain the current conducted through the load at a minimum value.

By way of example, the above-described circuit has been built with the values of the resistive components being as follows:

| RESISTOR | VALUE |
|---|---|
| 108 | 2,200 ohms |
| 138 | 4,000 ohms |
| 134 | 866 ohms |
| 122 | 3,000 ohms |
| 124 | 33,000 ohms |
| 128 | 3,000 ohms |
| 126 | 15,000 ohms |
| 82 | 22,400 ohms |
| 81 | 17,600 ohms |
| 83 | 17,000 ohms |
| 85 | 20,000 ohms |
| 70 | 20,000 ohms |
| 72 | 20,000 ohms |
| 50 | 20,000 ohms |
| 94 | 4,000 ohms |
| 92 | 12,000 ohms |
| 90 | 5,000 ohms |
| 43 | 5,000 ohms |
| 42 | 26 ohms |

What has been described, therefore, is an improved current limit circuit which is suitable for manufacture in integrated circuit form. The current limit circuit configurations of FIG. 2 and FIG. 4 switch from a low-impedance state to a high-impedance state in response to circuit overload conditions. Moreover, thermal shutdown is employed in the current limit circuit configuration of the invention to protect the devices of the current limit circuit from being damaged due to excessive power dissipation which will occur during current overload conditions. In addition, a current limiting circuit is provided for limiting the maximum magnitude of current which may be conducted through a load element of the circuit.

While the above-detailed description as shown, described and pointed out the fundamental novel features of the invention, it will be understood that various substitutions, and changes in the form and details of the circuits and methods illustrated may be made by those skilled in the art without departing from the spirit of the invention. It is the intention, therefore, to limit the claimed invention only by the scope of the following claims.

What is claimed is:

1. A current limit circuit having an input and output terminal and being suitable to be operatively connected in series with a supply voltage and a load comprising:

means for providing a load current to the load including first reference voltage means for providing a substantially constant reference voltage and negative feedback means for providing negative feedback so that the voltage across the current limit circuit remains substantially constant with changes in said load current, said means for providing a load current being operatively coupled between the input and output terminals of the current limit circuit and having an output terminal;

current limiting means operatively coupled between said means for providing a current to the load and the load for sensing said current conducted therethrough to limit said current to a predetermined magnitude in response to a current overload condition; and thermal responsive means operatively coupled between the load and said means for providing a current to the load and being rendered operative for reducing said current to the load to a minimum value in response to said current overload condition, said thermal responsive means being periodically rendered inoperative and then operative until said current overload condition is corrected at which time said thermal responsive means is then rendered inoperative.

2. The current limit circuit in accordance with claim 1 wherein said means for providing a load current to the load includes:

said first voltage reference means being adapted to be connected across the input and output terminals of the current limit circuit and providing said substantially constant reference voltage at an output terminal thereof;

second voltage reference means adapted to be connected across the input and output terminals of the current limit circuit for providing a reference voltage at an output terminal thereof said second voltage reference means being responsive to the voltage applied thereacross; and error amplifier means having first and second input terminals and an output terminal and including a first amplifier and a second amplifier, said first input terminal being connected to said output terminal of said first voltage reference means said second input terminal being connected to said output terminal of said second voltage reference means, said output terminal of said error amplifier means being connected to an output of said second amplifier and said output terminal of said means for providing a load current to the load, said first amplifier being serially connected to said second amplifier and to said first and second input terminals of said error amplifier at first and second input terminal thereof.

3. The circuit in accordance with claim 2 wherein said error amplifier further includes:

said first amplifier including an operatonal amplifier; and having first and second input terminals connected to said first and second input terminals of said first amplifier respectively, and an output terminal;

said second amplifier including at least one electron control means having first and second electrodes and a control electrode, said control electrode being coupled to said output terminal of said operational amplifier, said first electrode being connected to said output terminal of said error amplifier, and said second electrode being coupled to the input terminal of the current limit circuit; and said second amplifier providing said negative feedback to said second voltage reference means so as to maintain the voltage across the current limit circuit substantially constant.

4. The circuit in accordance with claim 3 wherein said thermal responsive means includes:

additional electron control means having a control electrode, a first and a second electrode, said control electrode being coupled to said first input terminal of said operational amplifier, said first electrode being connected to the output terminal of the current limit circuit, and said second electrode being connected to said output terminal of said first amplifier; and resistive means having first and second terminals, said first terminal being connected to said control electrode of said additional electron control means, and said second terminal being connected to the output terminal of the current limit circuit.

5. The circuit in accordance with claim 3 wherein said current limiting means includes:

first additional electron control means having a control electrode, a first and a second electrode, said control electrode being connected to said output terminal of said error amplifier, said first electrode being connected to the output terminal of the current limit circuit, and said second electrode being connected to said output terminal of said first amplifier;

first resistive means having first and second terminals, said first terminal being connected to said control electrode of said first additional electron control means, and said second terminal being connected to the output terminal of the current limit circuit; and said first additional electron control means being rendered conductive in response to the current conducted through said first resistive means becoming substantially equal to a predetermined magnitude to shunt current drive away from said second amplifier means thereby limiting the current conducted through said first resistive means and to the load to said predetermined magnitude.

6. The circuit in accordance with claim 5 wherein said thermal responsive means includes:

second additional electron control means having a control electrode, a first electrode and a second electrode, said control electrode being coupled to said first input terminal of said error amplifier, said first electrode being connected to the output terminal of the current limit circuit, and said second electrode being connected to said output terminal of said first amplifier; and second resistive means having first and second terminals, said first terminal being connected to said control electrode of said second additional electron control means, and said second terminal being connected to the output terminal of the current limit circuit.

7. The circuit in accordance with claim 6 wherein said error amplifier further includes:

said operational amplifier having a common terminal, said common terminal being connected to a constant current source;

additional electron control means having a control electrode and a first and a second electrode, said control electrode being connected to said output terminal of said operational amplifier, said first electrode being connected to said constant current source, and said second electrode being connected to the ouput terminal of the current limit circuit; and said at least one electron control means of said second amplifier including a plurality of cascoded electron control means, and said control electrode of said at least one electron control means being connected to said first electrode of said additional electron control means.

8. A current limit circuit suitable to be manufactured in monolithic integrated circuit form and having an input terminal and an output terminal and adapted to be connected in series between a power supply and a load, the current limit circuit being adapted to limit the current supplied to the load to a predetermined maximum value in response to a current overload condition, comprising:

first amplifier means having a first and second input terminal, a common terminal and an output terminal said common terminal being connected to a constant current source;

first voltage reference means for generating a substantially constant voltage in response to the power supply and having first and second terminals and an ouput terminal, said first and second terminals being connected between the input and output terminals, respectively, of the current limit circuit, and said output terminal being connected to said first input terminal of said first amplifier means;

second voltage reference means responsive to the voltage developed thereacross for supplying a voltage level to said first amplifier means and having a first and a second input terminal and an output terminal, said first and second input terminals being connected to the input and output terminal of the current limit circuit respectively and said output terminal being connected to said second input terminal of said first amplifier means;

second amplifier means for providing negative feedback to said first amplifier means to maintain the voltage generated across the input and output terminals of the current limit circuit substantially constant and for providing a current to the load having an input terminal connected to said output terminal of said first amplifier means, first and second output terminals, said first output terminal being connected to the input terminal of the current limit circuit, and including at least one electron control means having a control electrode, a first electrode, and a second electrode, said control electrode being connected to said input terminal of said second amplifier means, said first electrode being coupled to said second output terminal of said second amplifier means and said second electrode being coupled to said first output terminal of said second amplifier means;

current limiting means operatively connected between said input terminal and said second output terminal of said second amplifier means and the output terminal of the current limit circuit for limiting the current supplied to the load to a predetermined maximum value in response to the current overload condition;

thermal responsive means operatively connected between said output and first input terminal of said first amplifier means and the output terminal of the current limit circuit and being rendered operative when the temperature of the current limit circuit becomes greater than a predetermined magnitude in response to the current overload condition for reducing the current supplied to the load to a minimum value, said thermal responsive means being periodically rendered inoperative and then operative once again until such time that the current overload condition may be converted.

9. The circuit in accordance with claim 8 wherein said first amplifier means includes:

an operational amplifier having first and second input terminals and a common terminal corresponding to said first, said second and said common terminal respectively, of said first amplifer means and having an output terminal; and additional electron control means having a control electrode a first electrode and a second electrode, said control electrode being connected to said output terminal of said operational amplifier, said first electrode being connected to said constant current source and to said output terminal of said first amplifier means and said second electrode being connected to the output terminal of the current limit circuit.

10. The circuit in accordance with claim 8 wherein said at least one electron control means includes:

first electron control means having a control electrode which is said control electrode of said at least one additional electron control means, and first and second electrodes;

second electron control means having a control electrode, a first and a second electrode, said control electrode being connected to said first electrode of said first electron control means, and first electrode being connected to said second output terminal of said second amplifier means;

first resistive means coupling said first electrode of said first electron control means to the output terminal of the current limit circuit;

said second voltage reference means having an additional output terminal;

third electron control means having a control electrode, a first electrode and a second electrode, said control electrode being connected to said additional output terminal of said second voltage reference means, said first electrode being connected to said second electrode of said first electron control means, and said second electrode being connected to said first output terminal of said second amplifier means; and fourth electron control means having a control electrode, a first electrode and a second electrode, said control electrode being connected to said first electrode of said third electron control means, said first electrode being connected to said second electrode of said second electron control means; and said second electrode being connected to said second electrode of said third electron control means.

11. The circuit in accordance with claim 10 wherein said current limiting means includes:

second resistive means coupling said second output terminal of said second amplifier means to the output terminal of the current limit circuit; and fifth electron control means having a control electrode, a first electrode and a second electrode, said control electrode being connected to said second output terminal of said second amplifier means, said first electrode being connected to the output terminal of the current limit circuit, and said second electrode being connected to said output terminal of said first amplifier means.

12. The circuit in accordance with claim 11 wherein said thermal responisve means includes:

sixth electron control means having a control electrode, a first electrode and a second electrode, said control electrode being coupled to said first input terminal of said operational amplifier; said first electrode being connected to the output terminal of the current limit circuit, said second electrode being connected to said output terminal of said first amplifier means; and third resistive means coupling said control electrode of said sixth electron control means to the output of the current limit circuit.

* * * * *